US005466040A

United States Patent [19]

Fainsztein

[11] Patent Number: 5,466,040

[45] Date of Patent: Nov. 14, 1995

[54] HIGH RISE EVACUATION CHAIR

[76] Inventor: Henry Fainsztein, 8582 Keel Dr., Huntington Beach, Calif. 92646

[21] Appl. No.: 186,857

[22] Filed: Jan. 27, 1994

[51] Int. Cl.[6] ..... A61G 1/00

[52] U.S. Cl. ..... 297/183.6; 5/625; 224/161

[58] Field of Search ..... 297/183.1, 183.6, 297/327, 344.1; 5/81.1, 89.1, 625; 224/158–161, 209, 210, 259, 260; 294/140

[56] References Cited

U.S. PATENT DOCUMENTS

| | | | |
|---|---|---|---|
| 620,694 | 3/1899 | Chadwick | 224/160 X |
| 1,185,698 | 6/1916 | Miller | 224/260 |
| 2,779,389 | 1/1957 | Pearl | 297/327 |
| 3,258,788 | 7/1966 | Anciaux | 5/625 |
| 3,486,671 | 12/1969 | Sanders | 5/625 X |
| 4,963,762 | 10/1990 | Brooks | 297/103 |

FOREIGN PATENT DOCUMENTS

| | | | |
|---|---|---|---|
| 853891 | 3/1940 | France | 5/625 |
| 17358 | 11/1955 | Germany | 297/327 |
| 1503806 | 9/1989 | U.S.S.R. | 5/625 |
| 796 | of 1855 | United Kingdom | 5/625 |
| 515119 | 11/1939 | United Kingdom | 5/625 |

*Primary Examiner*—Peter R. Brown

[57] ABSTRACT

A device for evacuating elderly, infirm, smoke-inhalation victims or the like from a structure accessible by stairs such as the fire stairs in the high rise building which comprises a supporting seat or chair for such persons mounted on a pair of stretcher-like bars, said bars in turn being supported at each end thereof by a carrying harness adapted to fit over the head and shoulders of each of two persons carrying such device thereby freeing the hands of such persons to grasp stair rails, walls or the like while carrying the device.

3 Claims, 4 Drawing Sheets

HIGH RISE EVACUATION CHAIR

BACKGROUND OF THE INVENTION

1. Field of the Invention

The present invention relates to stair chairs and more particularly pertains to such a chair which may be carried by two people while leaving the hands of such persons free.

2. Description of the Prior Art

The use of stair chairs is known in the prior art. More specifically, such chairs heretofore devised and utilized for the purpose of carrying a person up or down stairs are known to consist basically of familiar, expected and obvious structural configurations, notwithstanding the myriad of designs encompassed by the crowded prior art which have been developed for the fulfillment of countless objectives and requirements. Typical devices of this kind are shown in U.S. Pat. No. 3,279,734 and 4,688,279. A device very similar to the present invention is shown in U.S. Pat. No. 4,963,762. However this device, as is common to the art, requires that persons carrying the stair chair utilize both hands to support the device. Going down multiple steep flights of stairs with frequent turns for landings carrying such stair chairs is extremely hazardous.

In this respect, the stair chair according to the present invention substantially departs from the conventional concepts and designs of the prior art, and in so doing provides an apparatus primarily developed for the purpose of freeing the hands of persons carrying a stair chair for much greater safety, both of the carriers and the person being carried.

Therefore, it can be appreciated that there exists a continuing need for new and improved stair chairs which can be moved more easily and safely. In this regard, the present invention substantially fulfills this need.

SUMMARY OF THE INVENTION

In view of the foregoing disadvantages inherent in the known types of stair chairs now present in the prior art, the present invention provides an improved high rise evacuation chair construction wherein the same can be carried while leaving the hands of the carriers free. As such, the general purpose of the present invention, which will be described subsequently in greater detail, is to provide a new apparatus which has many of the advantages of the stair chair mentioned heretofore and many novel features that result in a stair chair which is not anticipated, rendered obvious, suggested, or even implied by any of the prior art devices, either alone or in any combination thereof.

To attain this, the present invention generally relates to a device for evacuating elderly, infirm, smoke-inhalation victims or the like from a structure accessible by stairs such as the fire stairs in the high rise building which comprises a supporting seat or chair for such persons mounted on a pair of stretcher-like bars, said bars in turn being supported at each end thereof by a carrying harness adapted to fit over the head and shoulders of each of two persons carrying such device thereby freeing the hands of such persons to grasp stair rails, walls or the like while carrying the device.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stair chair apparatus which has many of the advantages of the devices mentioned heretofore and many novel features that result in a high rise evacuation chair which is not anticipated, rendered obvious, suggested, or even implied by any of the prior art devices, either alone or in any combination thereof.

It is another object of the present invention to provide a new and improved high rise evacuation chair which may be easily and efficiently manufactured and marketed.

It is a further object of the present invention to provide a new and improved high rise evacuation chair which is of a durable and reliable construction.

An even further object of the present invention is to provide a new and improved high rise evacuation chair which is susceptible of a low cost of manufacture with regard to both materials and labor, and which accordingly is then susceptible of low prices of sale to the consuming public, thereby making such chairs economically available to the buying public.

Still yet another object of the present invention is to provide a new and improved stair chair which provides in the apparatuses of the prior art some of the advantages thereof, while simultaneously overcoming some of the disadvantages normally associated therewith.

Still another object of the present invention is to provide a new and improved high rise evacuation chair which permits free use of the hands of the persons carrying such chair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
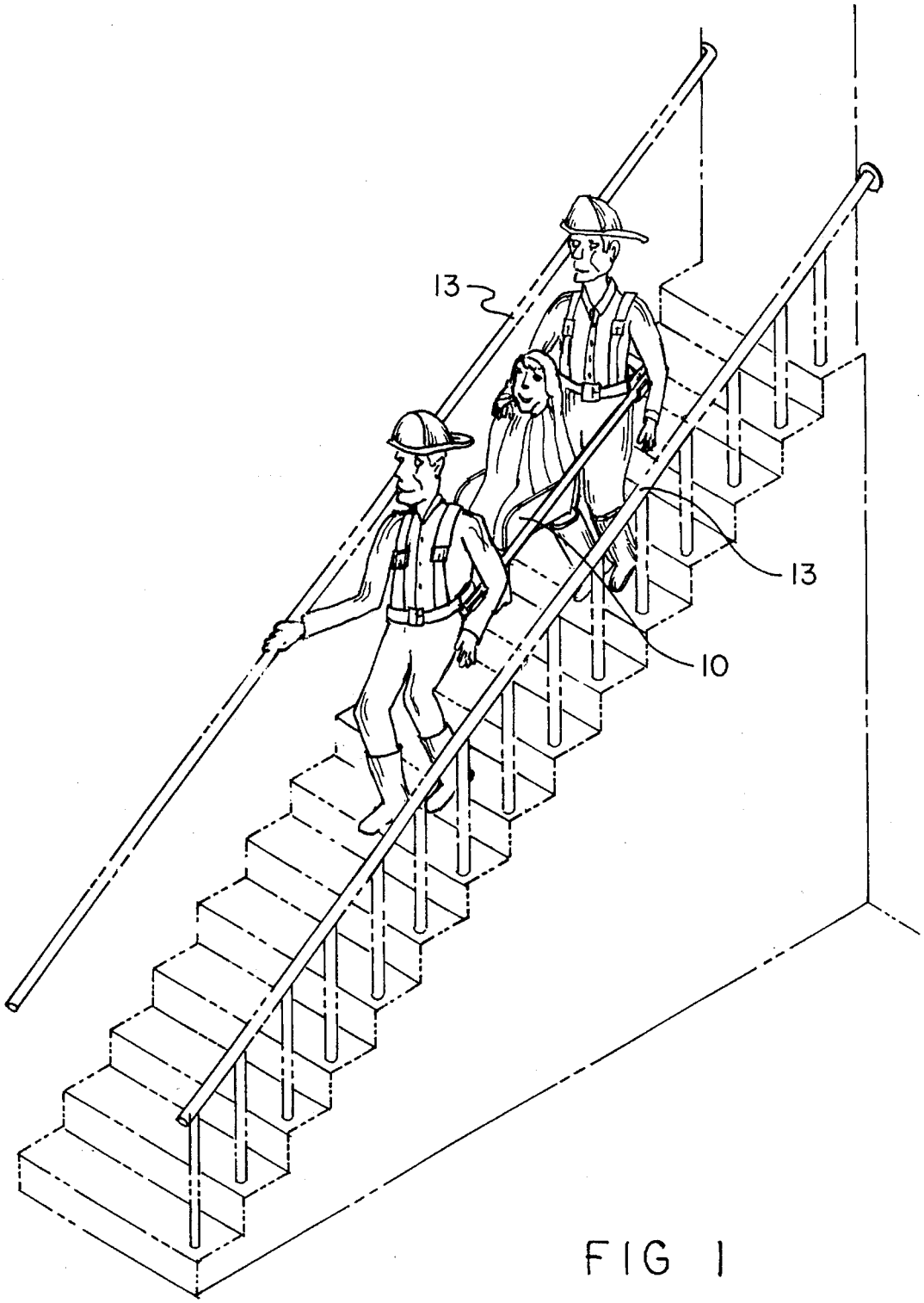
FIG. 1 is a perspective view of the device of the present invention.

With reference now to the drawings, and in particular to FIG. 1 thereof, a new and improved high rise evacuation chair embodying the principles and concepts of the present invention and generally designated by the reference numeral 10 will be described.

More specifically, it will be noted that the most immediately noticeable feature of the present stair chair 10 is that the persons 11 and 12 carrying such chair 10 have their hands free to permit such persons to hold onto stair rails 13 to steady themselves while transporting such chair 10 down a steep flight of stairs 14 such as are commonly found in the fire safety wells of high rise buildings.

Figure 3:
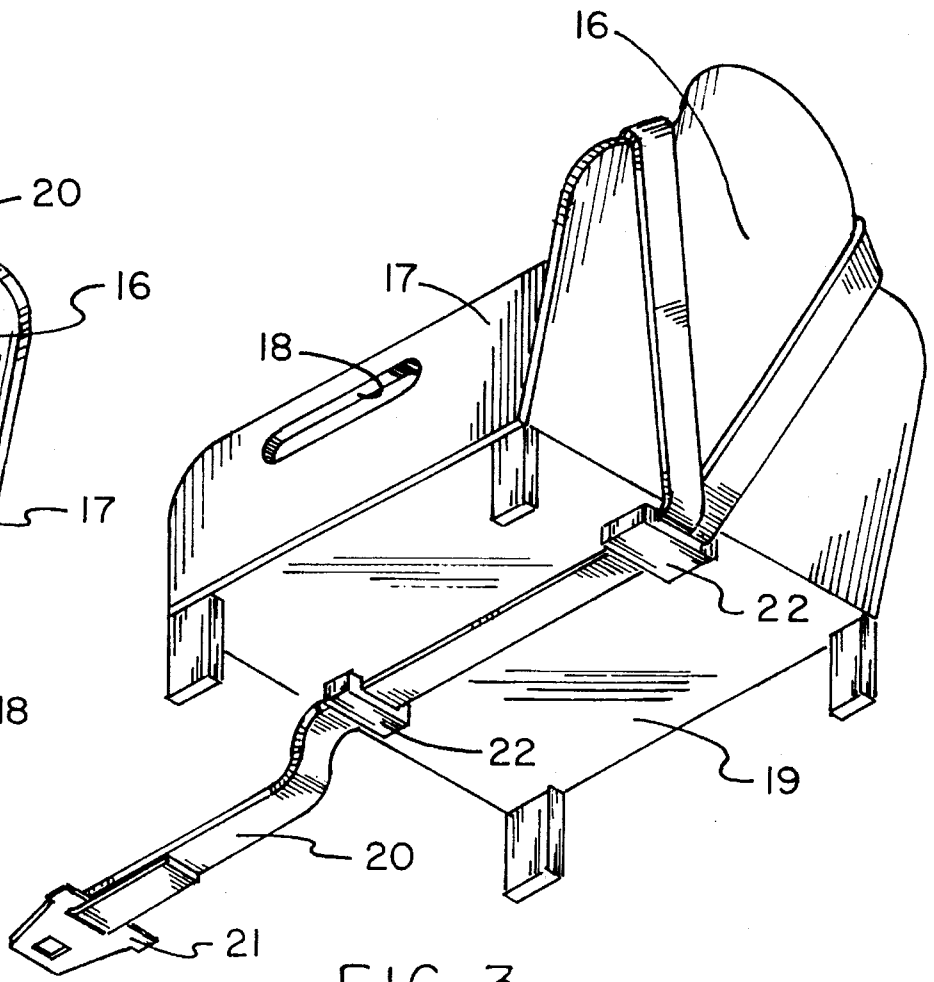
FIG. 3 is a bottom view of the seat of FIG. 2.
Figure 2:
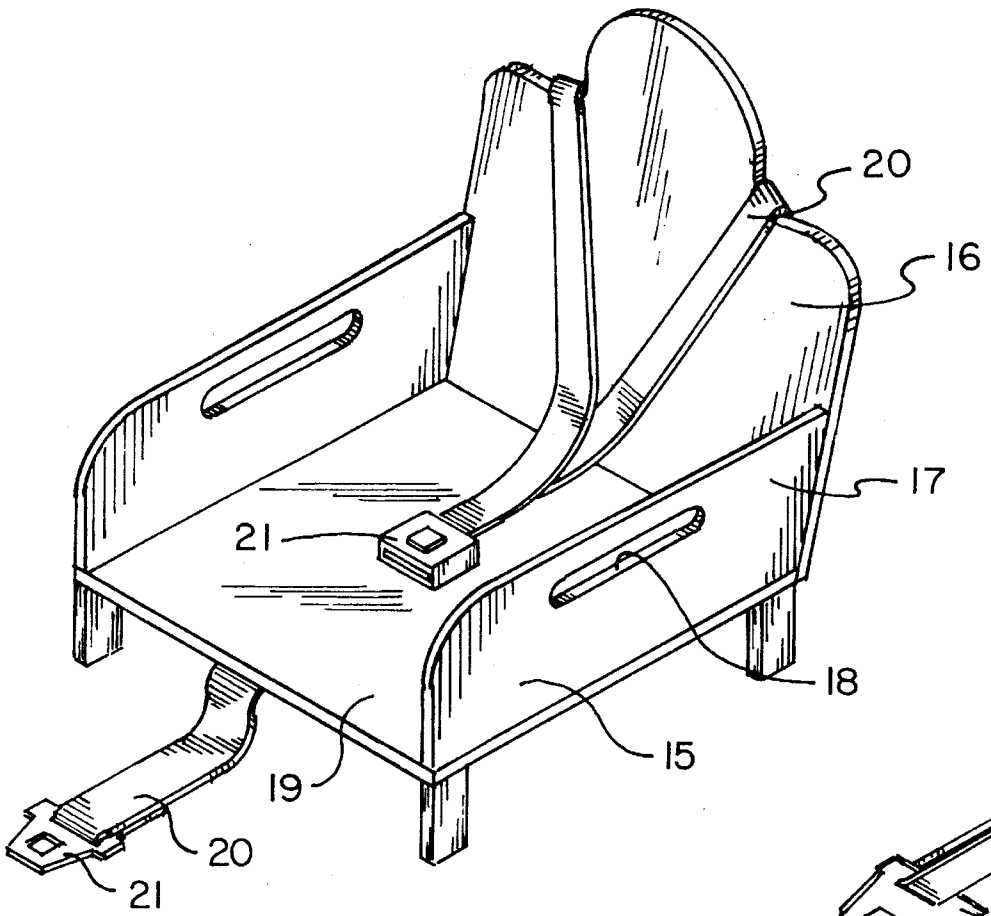
FIG. 2 is a top view of the seat portion of the present invention.

FIGS. 2 and 3 illustrate the seat portion 15 of the present invention. Seat 15 comprises a shallow chair having a slightly inclined vertical back member 16; side arm members 17 (each having a slot 18 therein to facilitate securing seat 15 to the carrying side bars illustrated below); a flat seat support 19 firmly secured to said side and back members 16 and 17; and a flexible strap harness 20 secured to the flat seat support 19 and extending over the back member 16 and flat seat support 19 where the harness 20 is secured by seat belt type buckles 21. As shown in FIG. 3, the harness 20 passes under seat support 19 and is slideably fastened thereto by passage through a pair of U-shaped brackets 22 secured to the underside of seat supports 19.

Figure 4:
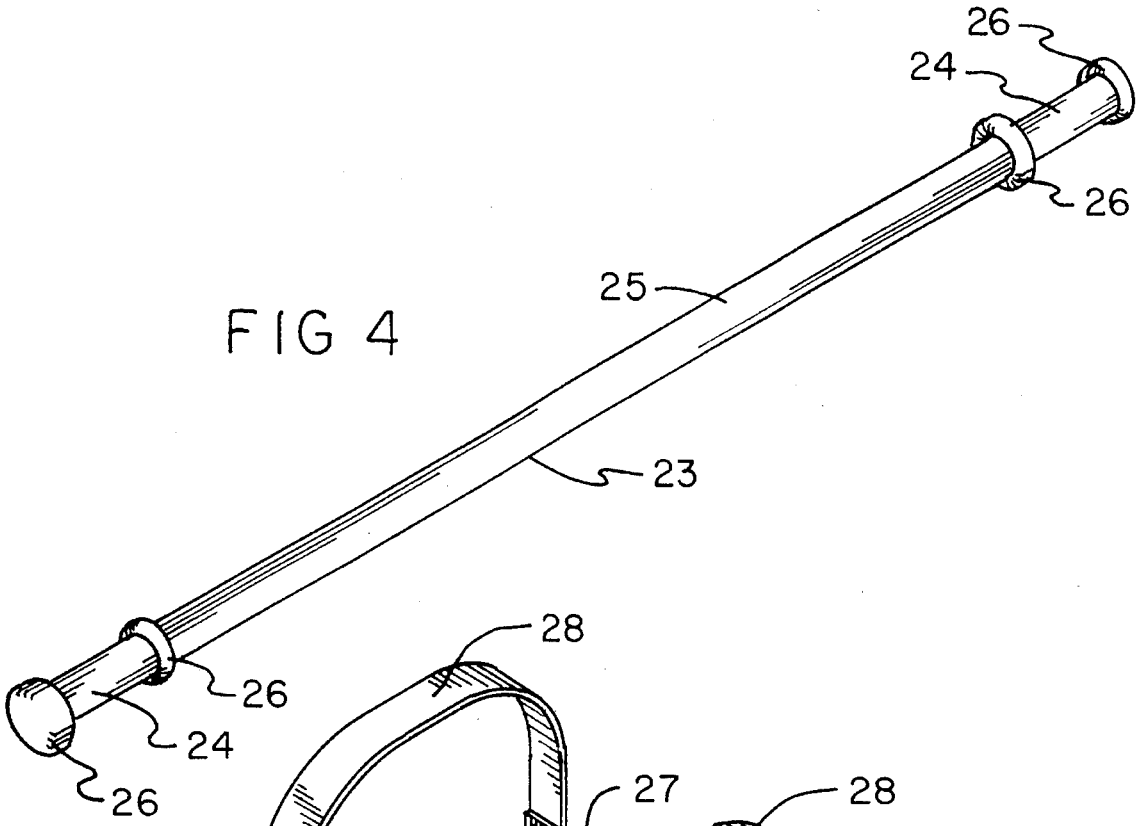
FIG. 4 is a perspective view of one of the carrying bars of the present invention.

FIG. 4 illustrates a carrying bar 23 for the seat portion 15 to which such seat 15 is secured as hereinafter shown in FIGS. 6 and 7. Bar 23 comprises a preferably tubular, longitudinal, straight shaft 25 having a pair of support handles 24 at each end thereof. Handles 24 are provided with raised circular detent members 26 at each end thereof. Such detent members 26 are spaced so that, if necessary, support handles 24 could be used to mechanically carry bar 23 and also to facilitate placing bar 23 in its normal carrying position as described in connection with FIG. 5.

Figure 5:
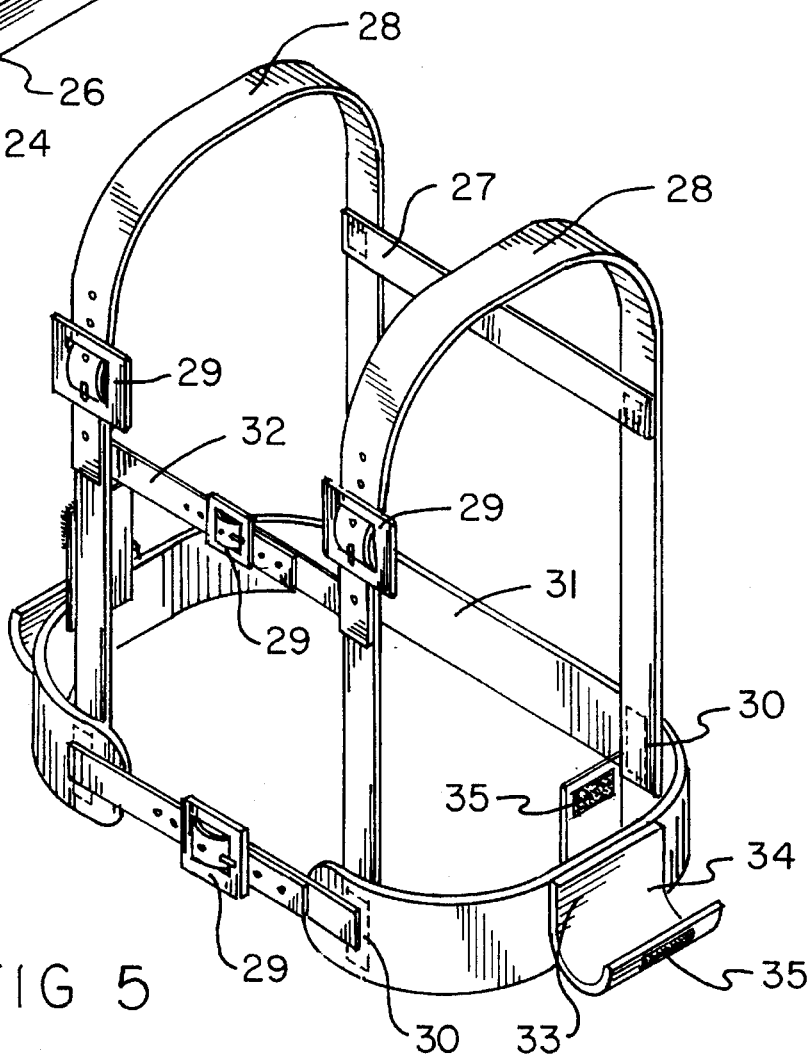
FIG. 5 is a front perspective view of one of the shoulder harnesses of the present invention.

FIG. 5 shows one of a pair of shoulder harnesses 27 which form the most essential elements of the stair chair 10 of the present invention. Harness 27 is made up of a pair of flexible straps 28 which are designed to pass over the shoulders of the wearer. Such straps 28 are each provided with adjusting buckles 29 to permit adjustment to the build of the wearer and to permit removal of the harness 27. Straps 28 are permanently fastened at their lower ends 30 to a waist encircling strap 31 which also has a similar adjusting buckle 29 therefor. A sternum strap 32 and associated adjusting buckle 29 is provided connecting the two shoulder straps 28 to prevent such straps 28 from slipping off the shoulders of the wearer. Positioned at each side of the waist encircling strap 31 and secured thereto is a rigid bar support 33 in the form of an upwardly opening U 34. The dimensions of such U are such as to permit the handle 24 to fit therein with the raised detents 26 at each end of such handle 24 preventing forward or back sliding of such handles 24. As an added safety feature, hook and loop fabric fastening patches 35 may be secured to bar support 33 as shown in FIG. 5. A mating fabric strap (not shown) may be wrapped over the support carrying bar 23 and secured to patches 35 if desired.

Figures 6, 7:
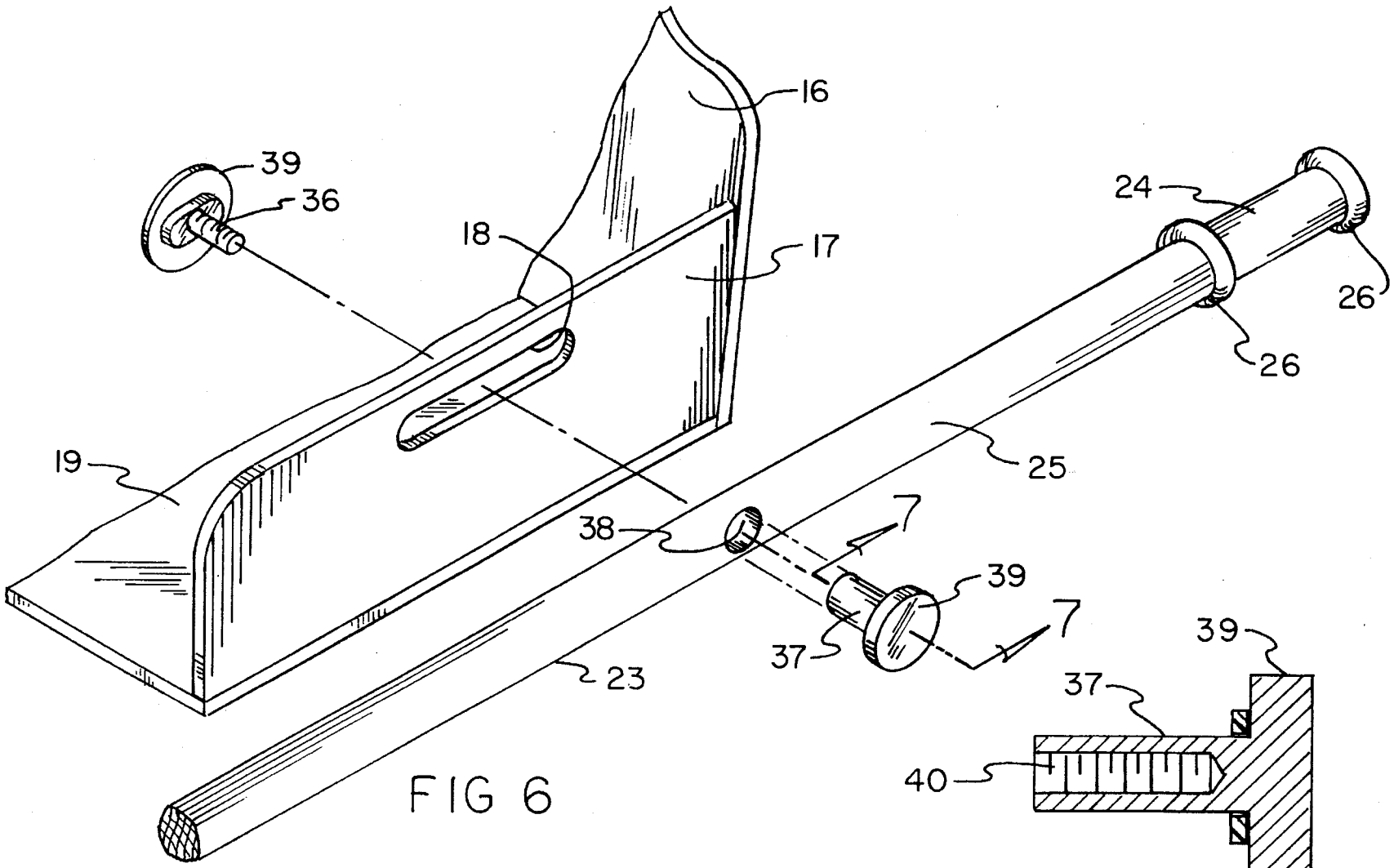
FIG. 6 is an exploded perspective view of the fastening means connecting the chair and bars of the present invention
FIG. 7 is a sectional view on line 7—7 of FIG. 6.

FIG. 6 illustrates the means for securing the seat portion 15 to the carrying bars 23. This comprises a large diameter externally threaded bolt 36 and associated internally threaded receptacle 37. Bolt 36 extends through the slot 18 of side member 19 and engages with receptacle 37 extending through a hole 38 in shaft 25 of carrying support bar 23. This arrangement permits tilting seat portion 15 to any desired angle and securing such seat portion 15 in the desired position by tightening bolt 36 into receptacle 37. Both members 36 and 37 have enlarged heads 39 thereon for ease in tightening.

FIG. 7 is a sectional view of receptacle 37 showing the internal threads 40 therein.

The seat portion 15 and carry support bars 23 are preferably made of wood although high strength rigid plastic may also be used. The harness 27 and its associated straps are preferably made of leather.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A high rise evacuation chair which comprises: a supporting seat for victims to be carried thereby; a pair of rigid longitudinal shafts; means for adjustably securing said supporting seat to said pair of shafts; a plurality of handle members with one handle member oriented at each end of said pair of shafts; a plurality of raised circular detent members extending exteriorly from each end of each of said handle members; and a pair of flexible shoulder harnesses removably attached to said handle members, one harness at each end of said shafts and associated handle members, whereby the weight of said seat and its encompassed victim as well as that of said shafts is supported solely by said shoulder harnesses thus freeing the hands of persons carrying such chair and wearing said harnesses;

said means adjustably securing said supporting seat to said pair of shafts comprises a plurality of externally threaded bolts with one of said bolts extending through one of the sides of said supporting seat and an internally threaded receptacle for such bolt extending through each of said pair of rigid longitudinal shafts and engaging with said externally threaded bolts, each of said sides having a longitudinal slot to adjustably receive one of said bolts.

2. A chair as in claim 1 wherein said flexible shoulder harnesses each comprise a pair of flexible shoulder straps; a waist encircling belt strap having spaced sides, both ends of each of said shoulder straps being secured to said waist encircling belt strap; and a rigid bar supporting U-shaped member affixed to each of said sides of said waist encircling belt strap.

3. A chair as set forth in claim 2 with the belt strap having a plurality of fastening straps, with one of said fastening straps cooperatively oriented adjacent to one of said rigid bar supporting U-shaped members, each of said fastening straps having securement means for selective securement to said one of said rigid bar supporting U-shaped members.

* * * * *